United States Patent [19]

Toews

[11] 4,332,119

[45] Jun. 1, 1982

[54] WALL OR PANEL CONNECTOR AND PANELS THEREFOR

[76] Inventor: Norman J. Toews, Box 220, Steinbach, Manitoba, Canada

[21] Appl. No.: 126,641

[22] Filed: Mar. 3, 1980

[30] Foreign Application Priority Data

Mar. 5, 1979 [CA] Canada ..... 332762

[51] Int. Cl.[3] ..... E04B 2/00

[52] U.S. Cl. ..... 52/772; 52/762; 52/481; 52/588; 52/568

[58] Field of Search ..... 52/772, 762, 481, 588, 52/568

[56] References Cited

U.S. PATENT DOCUMENTS

| | | | |
|---|---|---|---|
| 3,229,441 | 1/1966 | Heffner | 52/481 |
| 3,304,677 | 2/1967 | Pavlecka | 52/481 |
| 3,574,985 | 4/1971 | Pier | 52/762 |
| 3,857,216 | 12/1974 | Sherman | 52/772 |
| 4,015,388 | 4/1977 | Hemminger | 52/772 |

FOREIGN PATENT DOCUMENTS

| | | | |
|---|---|---|---|
| 2237245 | 2/1974 | Fed. Rep. of Germany | 52/481 |

*Primary Examiner*—Reinaldo P. Machado
*Attorney, Agent, or Firm*—Stanley G. Ade

[57] ABSTRACT

Substantially rectangular panels are provided with claw engaging means along two opposing edges which are snap engageable within resilient claw ends formed on the opposite side edges of an elongated connector web thus holding the panels in spaced and parallel relationship. If the spacing is relatively wide, then a stiffening panel can be slidably engaged from the ends of the pairs of opposed panels. The web has jaws formed on each side thereof intermediate the ends of the web and the stiffener panel has T-shaped opposing edges slidably engageable with the jaws. The cavities defined by the webs and/or stiffening panels can be insulated by loose fill or by foam.

11 Claims, 5 Drawing Figures

WALL OR PANEL CONNECTOR AND PANELS THEREFOR

BACKGROUND OF THE INVENTION

This invention relates to new and useful improvements in the formation of panels from a relatively thin light weight metal, plastic or the like.

Conventionally, such panels, utilized for garage doors, walls or the like require a frame unless the thickness and rigidity of the panel material is sufficient to be selfsupporting.

However, for many constructions, it is desirable to have a relatively light weight construction yet which is provided with sufficient strength for the purpose for which it is designed.

SUMMARY OF THE INVENTION

The present invention overcomes disadvantages inherent in conventional construction and in accordance with the invention, there is provided a connector web for securing adjacent panels together in spaced apart relationship in which said panels are substantially rectangular and are provided with web engaging means along a pair of opposing edges; said connector web comprising in combination a panel edge engaging claw assembly on each end of said web, the web engaging means on the associated panel snap engaging within said claw assembly, and a web extending between said panel edge engaging claw assemblies.

A further aspect of the invention contemplates the use of a stiffener panel intermediate the two parallel panels particularly if the distance between the opposing panels is relatively wide.

Another advantage of the invention, particularly when the material used is synthetic plastic, is the ease with which the beads can be formed on the edges of the panel by extrusion or other means.

Another advantage of the invention is the ease with which the webs can be formed by extrusion if synthetic plastic is utilized.

A still further advantage of the invention is to provide a construction of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
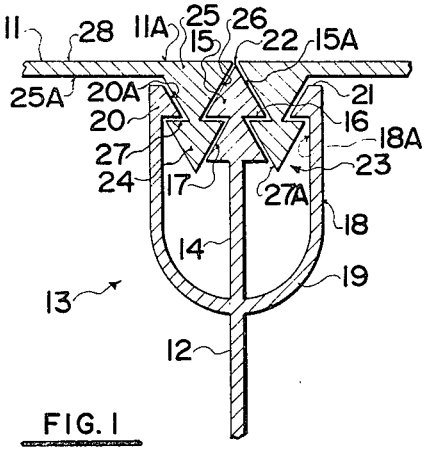
FIG. 1 is a fragmentary cross sectional view of two pairs of panels held together by one of the web connectors.

Proceeding therefore to describe the invention in detail, the invention consists primarily of a connector web collectively designated 10 to which may be secured substantially rectangular panels collectively designated 11.

The connector webs are preferably extruded from synthetic plastic and include a central vane or web 12 with a jaw assembly collectively designated 13 formed on each longitudinally extending side edge of the web 12.

Although the drawings show double jaw assemblies on each end of the web 12, nevertheless it will be appreciated that single jaw assemblies can be provided and are particularly useful for finishing the ends of the wall or door construction inasmuch as they are adapted to receive only one panel 11.

The jaw assemblies 13 include a central jaw portion 14 which extends as a continuation of the web or vane 12 and is provided with an elongated bead 15 on the distal end thereof which, in this embodiment, takes the form of an arrow head configuration when viewed in cross section. At the base 16 of the arrow head bead 15, the sides of the portion 14 extend outwardly and inwardly as indicated by reference character 17 to form in effect a second arrow head when viewed in cross section. However, it is the sloping side walls 17 which are of importance in this second arrow head configuration.

Outer jaws 18 extend upon each side of the central jaw 14 in the form of arcuately curved portions 19 which are resilient relative to the portion 14 which in turn may be resilient if desired.

Figure 3:
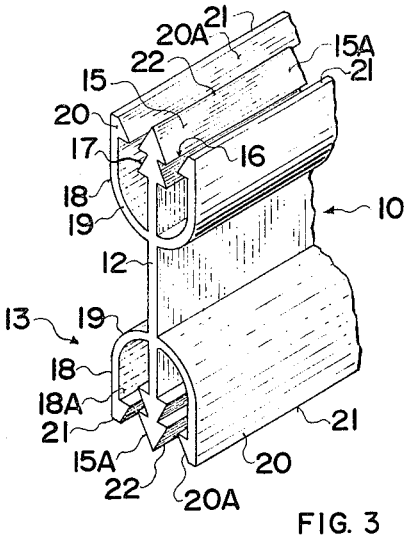
FIG. 3 is a fragmentary isometric view of the connector web.
Figure 2:
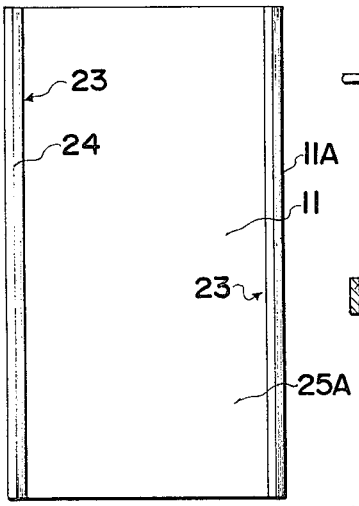
FIG. 2 is a plan view of one of the panels.

Inwardly facing hook portions 20 are formed on the upper ends of these portions 19 with the hooks facing the sides of the arrow head bead 16 as clearly illustrated in FIGS. 1 and 3. It will be noted that the upper end 21 of the hooked ends 20 are substantially planar and that the apex 22 of the central arrow head bead 15, projects slightly beyond the plane of the ends 21, to an amount substantially equal to the thickness of the associated panel 11. However, if desired, the apex 22 may be in alignment with the ends 21.

Figure 5:
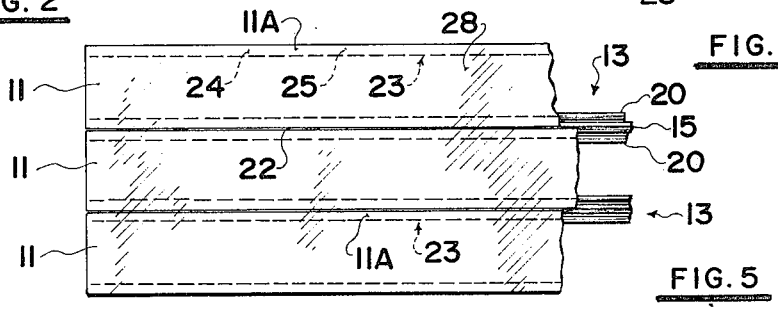
FIG. 5 is a fragmentary plan view of a section of a wall or door formed by the use of the present invention.

The panels 11 are provided with web engaging means along the longitudinal edges 11A of the panels, said means taking the form of elongated beads collectively designated 23 formed on the edges of the panels 11 and extending from one side thereof. In the present embodiment, these comprise a bead 24 spaced from the planar inner surface 25A of the panel and having a cross sectional configuration similar to that defined by the inner surfaces of the jaws 15 and 20. In this instance, the cross sectional configuration of this bead 24 is of an arrow head configuration supported from the panel 11 by means of a stem 25, the sides 26 of which slope inwardly towards the base 27 of the arrow head configuration as clearly illustrated so that when the panels are snap engaged between the central jaw 15 and either of the outer jaws 20, these sloping surfaces 26 register against the sloping surfaces 15A of the central jaw and 20A of the outer jaws and the sloping surfaces 27A of the bead 24 registers against the sloping surfaces 17 of the central jaw and the surface 18A of the portions 19 of the outer jaw thus holding the panel snugly into position. When two adjacent panels are snap engaged within the jaws as shown in FIG. 1, it will be noted that the edges of the outer surfaces 28 of the panels 11 are in proximity with one another thus giving a neat finish to the outer surface as shown in FIG. 5.

Figure 4:
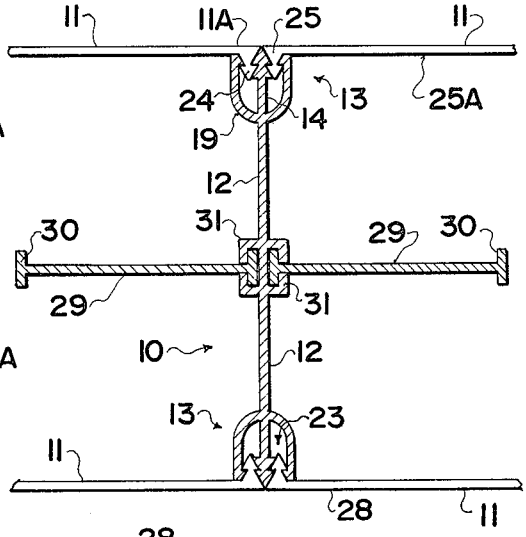
FIG. 4 is a view similar to FIG. 1, but showing a pair of stiffener panels incorporated therein.

If the space between the opposing panels 11 is relatively wide, then it may be desirable to provide a central stiffening panel collectively designated 29 and shown in detail in FIG. 4. This panel is provided with a bead 30 along opposed longitudinal edges which is T-shaped when viewed in cross section in conjunction with the panel 29.

Jaws 31 are formed upon each side of the web portion 12 having a configuration similar to the configuration of the edge of the panel and the bead 30 so that these panels may be slid into the jaws to take up the position shown in FIG. 4. The cells formed thereby or the space between opposing panels may be filled with loose fill insulation or foamed in place insulation if desired and after the door or wall has been assembled thus providing a rigid light weight door or wall construction which is easily manufactured and shipped and readily assembled on site to the desired size or area.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. Connector means for securing adjacent panels together in spaced apart relationship in which said panels are substantially rectangular and are provided with web engaging means along a pair of opposing edges; said connector web comprising in combination a panel edge engaging claw assembly on each end of said web, the web engaging means on the associated panel snap engaging within said claw assembly, and a web extending between said panel edge engaging claw assemblies, said claw assembly including a central jaw portion and an outer jaw portion situated on each side of said central portion, at least said outer jaw portions being resilient whereby said outer jaw portions are normally urged towards said central jaw portion.

2. The connector web according to claim 1 in which each of said claw assemblies includes means to receive and hold the edges of two adjacent panels in planar relationship with one another.

3. The connector web according to claim 1 in which said jaw portions include hooked ends facing one another to engage around said web engaging means of the associated panel.

4. The connector web according to claim 1 in which each of said outer jaw portions and the facing portion of said central jaw portion, include hooked ends facing one another to engage around the web engaging means of the associated panel.

5. The connector web according to claim 1 which includes at least one panel engageable with each end of said connector web, each of said panels including web engaging means along opposing edges, snap engageable with the corresponding claw assembly of said connector web.

6. The connector web according to claim 2 which includes at least one panel engageable with each end of said connector web, each of said panels including web engaging means along opposing edges, snap engageable with the corresponding claw assembly of said connector web.

7. The connector web according to claim 1 in which said web engaging means includes a bead formed along said edges of said panel, the cross sectional configuration of said bead being similar to the cross sectional configuration of the claw assembly engageable thereby whereby said bead snap engages and is held by said claw assembly.

8. The connector web according to claim 7 which includes further claw means situated centrally of said web intermediate said first mentioned claw assemblies, and a stiffening panel, said stiffening panel including means on a pair of opposing edges detachably engageable within said further claw means.

9. The connector web according to claim 8 which includes further claw means situated centrally of said web intermediate said first mentioned claw assemblies, and a stiffening panel, said stiffening panel including means on a pair of opposing edges detachably engageable within said further claw means.

10. The connector web according to claim 1 which includes further claw means situated centrally of said web intermediate said first mentioned claw assemblies, and a stiffening panel, said stiffening panel including means on a pair of opposing edges detachably engageable within said further claw means.

11. The connector web according to claims 8 or 9 in which said further claw means includes a pair of opposing jaws, said means on the opposite edges of said stiffener panel comprising a bead projecting perpendicularly upon each side of said panel edge to form a T-shaped bead with said panel when viewed in cross section, said bead being slidably engageable within said opposing jaws formed in said further claw means.

* * * * *